US011173709B2

(12) United States Patent
Mallinson

(10) Patent No.: US 11,173,709 B2
(45) Date of Patent: Nov. 16, 2021

(54) METHOD OF INKJET PRINTING USING DIGITAL CONTROL OF JET FLOW IN VICINITY OF DROPLETS

(71) Applicant: MEMJET TECHNOLOGY LIMITED, Dublin (IE)

(72) Inventor: Samuel George Mallinson, North Ryde (AU)

(73) Assignee: Memjet Technology Limited

( * ) Notice: Subject to any disclaimer, the term of this patent is extended or adjusted under 35 U.S.C. 154(b) by 0 days.

(21) Appl. No.: 17/087,453

(22) Filed: Nov. 2, 2020

(65) Prior Publication Data

US 2021/0046752 A1 Feb. 18, 2021

Related U.S. Application Data

(63) Continuation of application No. 16/405,912, filed on May 7, 2019, now Pat. No. 10,850,508.

(60) Provisional application No. 62/668,753, filed on May 8, 2018.

(51) Int. Cl.
*B41J 2/045* (2006.01)

(52) U.S. Cl.
CPC ..... *B41J 2/04561* (2013.01); *B41J 2/04586* (2013.01)

(58) Field of Classification Search
CPC ..... B41J 2/04561; B41J 2/04586; B41J 2/04508; B41J 2202/21
See application file for complete search history.

(56) References Cited

U.S. PATENT DOCUMENTS

2016/0257140 A1* 9/2016 Miyakoshi ..... B41J 2/15

* cited by examiner

*Primary Examiner* — Bradley W Thies
(74) *Attorney, Agent, or Firm* — Cooley LLP

(57) ABSTRACT

A method of inkjet printing includes the steps of: feeding print media past a printhead; printing onto the print media via a stream of inkjet droplets ejected from the printhead; and generating a jet flow in the vicinity of the stream of inkjet droplets, wherein the jet flow is digitally controlled.

9 Claims, 1 Drawing Sheet

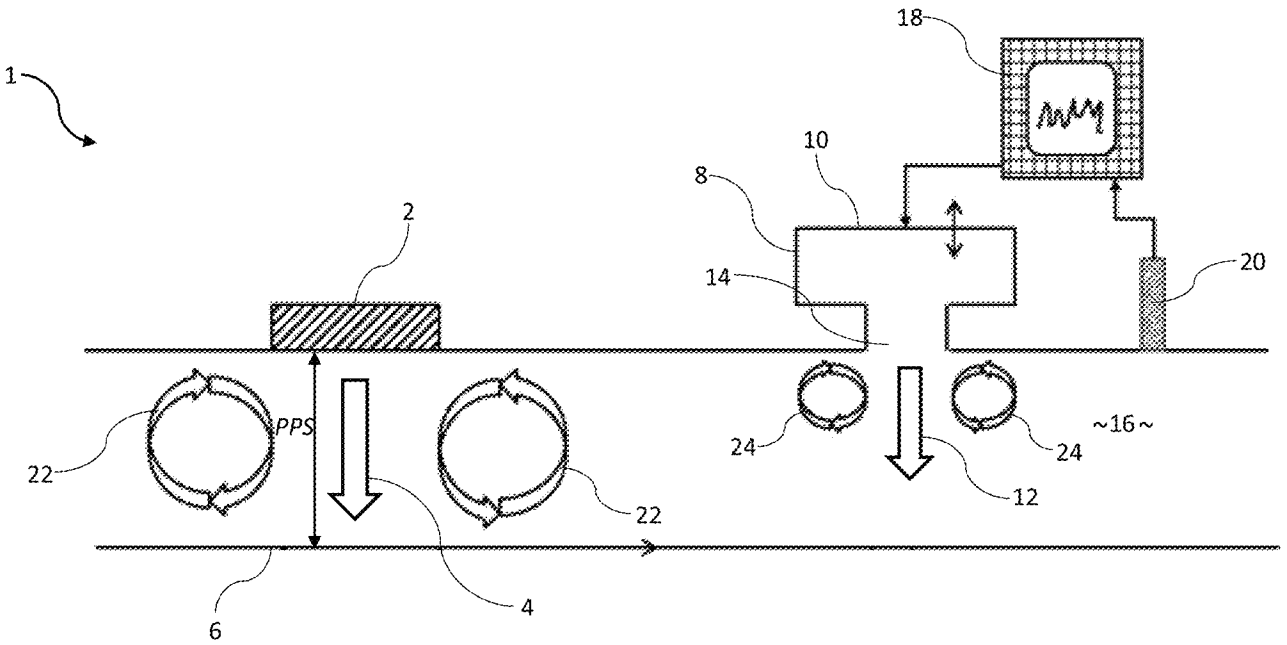
1
2
4
6
8
10
12
14
16
18
20
22
22
24
24
PPS

METHOD OF INKJET PRINTING USING DIGITAL CONTROL OF JET FLOW IN VICINITY OF DROPLETS

CROSS-REFERENCE TO RELATED APPLICATIONS

The present application is a continuation of U.S. application Ser. No. 16/405,912 filed May 7, 2019, which claims the benefit of priority under 35 U.S.C. § 119(e) of U.S. Provisional Application No. 62/668,753, entitled MODULATION OF VORTEX OSCILLATIONS IN INKJET SYSTEM USING SYNTHETIC JETS, filed May 8, 2018, the contents of which are hereby incorporated by reference in their entirety for all purposes.

FIELD OF THE INVENTION

This invention relates to inkjet printing. It is has been developed primarily for minimizing print artefacts caused by vortex oscillations associated with a stream of inkjet droplets during high-speed pagewide printing.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead in combination with a feed mechanism which feeds print media past the printhead in a single pass. Memjet® printers therefore provide much higher printing speeds than conventional scanning inkjet printers.

Pagewide printing at high speeds has a number of challenges and maintaining high print quality is paramount as pagewide technology propagates into new commercial printing applications. High-speed digital inkjet printing as an alternative to traditional offset printing is transforming the print industry; tailoring short print runs for individual customers without the high set-up costs of offset plates enables, for example, printed packaging to be individualized and targeted towards different consumers. However, a print artefact commonly associated with high-speed printing via a stream of inkjet droplets is known in the art as "woodgraining" (also known as "tiger-striping" or "sand-duning").

Woodgraining is evidenced by periodic stripes in a printout along the direction of media propagation. The stripes together have the effect of a visible woodgrain in printouts, particularly in regions of solid color. Woodgraining is particularly evident when a pen-paper-spacing (PPS)—the distance between the printhead and the print media—is relatively large. Typically, with a PPS of less than 1 mm, woodgraining artefacts are less noticeable; however, as the PPS increases, the woodgraining effects become more visible.

Without wishing to be bound by theory, it is understood by the present inventors that the appearance of woodgraining artefacts is caused by periodic oscillations of vortices associated with a stream of inkjet droplets (see U.S. Pat. No. 8,382,243, the contents of which are incorporated herein by reference). Each vortex tends to oscillate at its own natural frequency and these periodic oscillations affect the placement of ink droplets, resulting in woodgraining. With a higher PPS, the vortex oscillations have increased amplitude and droplet placement variations correspondingly increase; hence, the more noticeable effects of woodgraining with a higher PPS.

Industrial printing applications create demands for a higher PPS when printing onto different media, such as corrugated boards. It would therefore be desirable to mitigate the effects of woodgraining, especially when printing with relatively large or variable print gap (PPS).

U.S. Pat. No. 8,382,243 describes one means for mitigating the effects of woodgraining by introducing an airflow into the print gap between the printhead and the print media. The airflow disrupts the oscillating vortices associated with the inkjet droplet stream.

SUMMARY OF INVENTION

In a first aspect, there is provided a print assembly comprising:

- a printhead comprising a plurality of inkjet nozzle devices; and
- an array of synthetic jet devices configured to provide a jet flow in a vicinity of ink droplets ejected by the inkjet nozzles.

In one preferred embodiment, the print assembly further comprises:

- a sensor positioned downstream of the printhead relative to a media feed direction; and
- control circuitry connected to the synthetic jet devices, wherein the control circuitry is responsive to a signal received by the sensor.

Preferably, the sensor is configured to generate a signal indicative of a frequency of printing vortex oscillations associated with a stream of inkjet droplets ejected by the inkjet nozzle devices.

The sensor may comprise at least one of: an image sensor configured for sensing woodgraining stripes associated with the printing vortex oscillations; an air pressure sensor; and an air speed sensor.

Preferably, the control circuitry is configured to control one or more of the synthetic jet devices so as to minimize the printing vortex oscillation.

Preferably, the control circuitry is configured to actuate one or more of the synthetic jet devices so as to generate a jet flow having an associated jet vortex oscillation out of phase with the printing vortex oscillation.

Preferably, the jet vortex oscillation has a same frequency as a sensed printing vortex oscillation.

Preferably, the control circuitry is dynamically responsive to sensed variations in the printing vortex oscillation.

The printhead is typically a pagewide inkjet printhead configured for single-pass printing.

The array of synthetic jet devices may be positioned downstream of the printhead, upstream of the printhead or both upstream and downstream of the printhead relative to a media feed direction.

In a further aspect, there is provided a method of printing comprising the steps of:

- feeding print media past a printhead;
- printing onto the print media via a stream of inkjet droplets ejected from the printhead;
- generating a jet flow in the vicinity of the stream of inkjet droplets using an array of synthetic jet devices.

The method may further comprise the steps of:

- sensing a parameter indicative of printing vortex oscillations associated with the stream of inkjet droplets; and
- controlling the synthetic jet devices in response to the sensed parameter.

Typically, the parameter is a frequency of the printing vortex oscillations.

The sensing step may comprise sensing at least one of: an image printed by the printhead; an air pressure; and an air speed.

Advantageously, a distance between a lower surface of the printhead and an upper surface of the print media is in the range of 1 to 5 mm.

BRIEF DESCRIPTION OF THE DRAWINGS

Embodiments of the present invention will now be described by way of example only with reference to the accompanying drawings, in which:

FIG. 1 is a schematic side view of a print assembly according to one embodiment of the present invention.

DETAILED DESCRIPTION OF AN EMBODIMENT OF THE INVENTION

Referring to FIG. 1, there is shown, schematically, a print assembly 1 in accordance with one aspect of the present invention. The print assembly 1 comprises a pagewide inkjet printhead 2 ejecting a stream of ink droplets 4 onto print media 6 fed past the printhead in a media feed direction as shown. An array of synthetic jet devices 8 is positioned downstream of the printhead 2 relative to the media feed direction. Each synthetic jet 8 comprises an oscillating membrane 10, which produces a synthetic jet flow 12 through a jet nozzle 14 using the surrounding fluid medium 16 (i.e. air). The oscillating membrane 10 works by expelling fluid through the centre of the jet nozzle 14 during an 'upstroke' and then ingesting fluid near the edges of the jet nozzle during a 'downstroke. Typically, the oscillating membrane 10 is driven by a piezoelectric actuator (not shown), although other actuators (e.g. electromagnetic actuator, mechanical actuator etc.) are also with the ambit of the present invention.

The synthetic jet devices 8 are digitally controlled using suitable control circuitry 18, which receives feedback signals from a sensor 20 positioned in the vicinity of the printhead 2. In the embodiment shown, the sensor 20 is positioned downstream of the synthetic jet 8, although the sensor may be equally positioned between the printhead 2 and the synthetic jet, or even upstream of the printhead. Multiple sensors 20 both upstream and downstream of the printhead 2 are also contemplated within the scope of the present invention.

The sensor 20 may be of any type capable of producing a signal, which is indicative of a frequency of printing vortex oscillations 22 associated with the stream of ink droplets 4. For example, the sensor 20 may be an air pressure sensor detecting changes in air pressure in eth vicinity of the printhead 2. Alternatively, or additionally, the sensor 20 may be an air speed sensor. Alternatively, or additionally, the sensor 20 may be an image sensor detecting print artefacts indicative of the printing vortex oscillations. For example, the image sensor may sense a spacing and/or width of bands or stripes ("woodgraining") in a printout, which are a characteristic artefact of printing vortex oscillations. In some embodiments, multiple different types of sensor 20 may be used to provide a signal to the control circuitry 18 for controlling actuation of the synthetic jets 8.

The synthetic jets 8 are configured to generate the synthetic jet flow 12 having associated jet vortex oscillations 24, which mitigate the effects of the printing vortex oscillations 12. Optimally, the jet vortex oscillations 24 cancel out the printing vortex oscillations 12 by oscillating out of phase with the printing vortex oscillations at a same frequency. Feedback from the sensor(s) 20 enables the synthetic jets 8 to be digitally controlled so as to generate a synthetic jet flow 12, which dynamically minimizes the effects of the printing vortex oscillations. For example, the synthetic jets 8 may be adjusted dynamically in response to changes in image content, print speed and media thickness.

It is a particular advantage of the present invention that variations in the amplitude and frequency of printing vortex oscillations can be countered using the array of synthetic jets 8. For example, it is known that changes in the PPS (due, for example, to a change in media thickness) will produce different printing vortex oscillations. A PPS of more than 1 mm is known to produce visible woodgraining artefacts due to the increased printing vortex oscillations. The present invention enables a print assembly 1 for printing onto different thicknesses with minimal woodgraining artefacts, irrespective of the PPS. This obviates complex media feed arrangements for maintaining a consistent (small) PPS for different media types.

A further advantage of the present invention is that is obviates cumbersome hydraulic ducting in the print assembly 1 for directing an airflow into a print zone of the printhead 2. The compact synthetic jets 8 may be positioned very close to the printhead 1 (e.g. less than 30 mm, less than 20 mm or less than 10 mm from the printhead) and counter the printing vortex oscillations more effectively than conventional hydraulic ducting arrangements.

It will, of course, be appreciated that the present invention has been described by way of example only and that modifications of detail may be made within the scope of the invention, which is defined in the accompanying claims.

The invention claimed is:

1. A method of inkjet printing comprising the steps of:

feeding print media past a printhead;

printing onto the print media via a stream of inkjet droplets ejected from the printhead; and generating a jet flow in the vicinity of the stream of inkjet droplets, wherein the jet flow is digitally controlled.

2. The method of claim 1, wherein the jet flow is digitally controlled in response to a parameter indicative of printing vortex oscillations associated with the stream of inkjet droplets.

3. The method of claim 2, wherein the parameter is a frequency of the printing vortex oscillations.

4. The method of claim 2, further comprising a step of:

sensing at least one of: an image printed by the printhead; an air pressure; and an air speed.

5. The method of claim 2, wherein the jet flow is generated using an array of synthetic jet devices.

6. The method of claim 5, wherein a jet vortex oscillation associated with the jet flow is out of phase with a printing vortex oscillation.

7. The method of claim 6, wherein the jet vortex oscillation has a same frequency as a frequency of the printing vortex oscillation.

8. The method of claim 1, wherein the jet flow is controlled dynamically in response to sensed variations in a printing vortex oscillation.

9. The method of claim 1, wherein a distance between a lower surface of the printhead and an upper surface of the print media is in the range of 1 to 5 mm.

* * * * *